US011173518B2

(12) United States Patent
Kingston et al.

(10) Patent No.: US 11,173,518 B2
(45) Date of Patent: Nov. 16, 2021

(54) PROCESS FOR REUSING PRINTED CANS

(71) Applicant: WilCraft Can, LLC, Oak Creek, WI (US)

(72) Inventors: Sean P. Kingston, Oak Creek, WI (US); Matthew L. Koele, Random Lake, WI (US); Benjamin T. White, Racine, WI (US)

(73) Assignee: WilCraft Can, LLC, Oak Creek, WI (US)

( * ) Notice: Subject to any disclaimer, the term of this patent is extended or adjusted under 35 U.S.C. 154(b) by 69 days.

(21) Appl. No.: 16/544,729

(22) Filed: Aug. 19, 2019

(65) Prior Publication Data

US 2020/0055081 A1 Feb. 20, 2020

Related U.S. Application Data

(60) Provisional application No. 62/719,981, filed on Aug. 20, 2018.

(51) Int. Cl.

| | |
|---|---|
| ***B05D 3/06*** | (2006.01) |
| ***B65D 25/34*** | (2006.01) |
| ***B41M 5/00*** | (2006.01) |
| ***B05D 5/04*** | (2006.01) |

(52) U.S. Cl.

CPC ..... *B05D 3/06* (2013.01); *B05D 5/04* (2013.01); *B41M 5/0017* (2013.01); *B65D 25/34* (2013.01)

(58) Field of Classification Search

CPC . B05D 3/06; B05D 5/04; B65D 25/34; B41M 5/0017; B08B 7/0035; B08B 7/0042; B08B 7/005

USPC ..... 347/101, 104–107

See application file for complete search history.

(56) References Cited

U.S. PATENT DOCUMENTS

| | | | |
|---|---|---|---|
| 2,741,599 | A | 4/1956 | McDonald et al. |
| 3,960,073 | A | 6/1976 | Rush |
| 4,048,917 | A | 9/1977 | Skrypek et al. |
| 4,654,088 | A | 3/1987 | Fitzpatrick et al. |

(Continued)

FOREIGN PATENT DOCUMENTS

| | | | |
|---|---|---|---|
| EP | 0358338 | B1 | 7/1994 |
| EP | 2842747 | A1 | 3/2015 |
| WO | 95/02471 | A1 | 1/1995 |

OTHER PUBLICATIONS

Kathyanne White, "Recycling Beverage Cans to a Digital Print", published Mar. 3, 2009, YouTube video retrieved from internet at https://www.youtube.com/watch?v=9eoZzjN3fh4 on Nov. 18, 2019, 55 pages filed herewith.

(Continued)

*Primary Examiner* — An H Do

(74) *Attorney, Agent, or Firm* — Epiphany Law, LLC

(57) ABSTRACT

An in-line process for reusing printed cans is disclosed. The process includes positioning a printed can in front of a laser, the printed can having existing-print on an outer surface of the printed can. And, irradiating the outer surface of the printed can with laser radiation to remove 10% to 90% of the existing-print from the printed can and thereby form a lightened-printed can. And further, coating the outer surface of the lightened-printed can with a masking agent to form a blank-reprintable can. Finally, optionally, printing a new print-pattern on the outer surface of the blank-reprintable can to form a newly-printed can.

24 Claims, 1 Drawing Sheet

(56) References Cited

U.S. PATENT DOCUMENTS

| | | | | |
|---|---|---|---|---|
| 4,994,639 | A | 2/1991 | Dickinson et al. | |
| 5,018,640 | A | 5/1991 | Morofuji et al. | |
| 5,061,140 | A | 10/1991 | Hamaguchi et al. | |
| 5,085,999 | A | 2/1992 | Bowers-Irons et al. | |
| 5,248,343 | A | 9/1993 | Hamilton et al. | |
| 5,445,680 | A | 8/1995 | Hamilton | |
| 5,481,084 | A | 1/1996 | Patrick et al. | |
| 5,571,335 | A * | 11/1996 | Lloyd | B08B 7/0085 134/1 |
| 8,747,975 | B2 | 6/2014 | Makamura et al. | |
| 8,871,028 | B2 | 10/2014 | De Souza | |
| 8,919,247 | B2 | 12/2014 | Morgavi et al. | |
| 9,409,433 | B2 | 8/2016 | Carreras | |
| 9,573,358 | B2 | 2/2017 | Boas et al. | |
| 10,086,597 | B2 * | 10/2018 | Simko | B32B 43/006 |
| 10,086,602 | B2 | 10/2018 | Vilas Boas et al. | |
| 10,112,257 | B1 * | 10/2018 | Thomas | B23K 26/032 |
| 10,308,008 | B2 | 6/2019 | Behnke et al. | |
| 2008/0057336 | A1 | 3/2008 | Kurokawa et al. | |

OTHER PUBLICATIONS

Kathyanne White, "Digital Printing Beverage Cans", published Jan. 4, 2015, YouTube video retrieved from internet at https://www.youtube.com/watch?v=McoaPUj7aWQ on Nov. 18, 2019, 82 pages filed herewith.

Thescientistformerlyknownasnaegeli, "Ink removal from soda can," published Nov. 6, 2016 at https://www.instructables.com/id/Ink-Removal-From-Soda-Cans/, retrieved from internet on Nov. 18, 2019, 17 pages filed herewith from IDS originally submitted on Nov. 18, 2019, and YouTube video at https://youtu.be/HHWNqxCYMtA, 44 pages filed herewith.

Inkaid, "Introducing inkAID™", published Jan. 12, 2013 at https://www.inkaid1.com/, retrieved from the internet on Nov. 18, 2019, 2 pages filed herewith from IDS originally submitted on Nov. 18, 2019, and YouTube video at https://youtu.be/NB-IhJj7CVw, 59 pages filed herewith.

Unnamed, "cans printing machine", published Dec. 25, 2016 at https://youtu.be/FUAob95-iRE, retrieved from the internet on Nov. 18, 2019, 16 pages filed herewith.

* cited by examiner

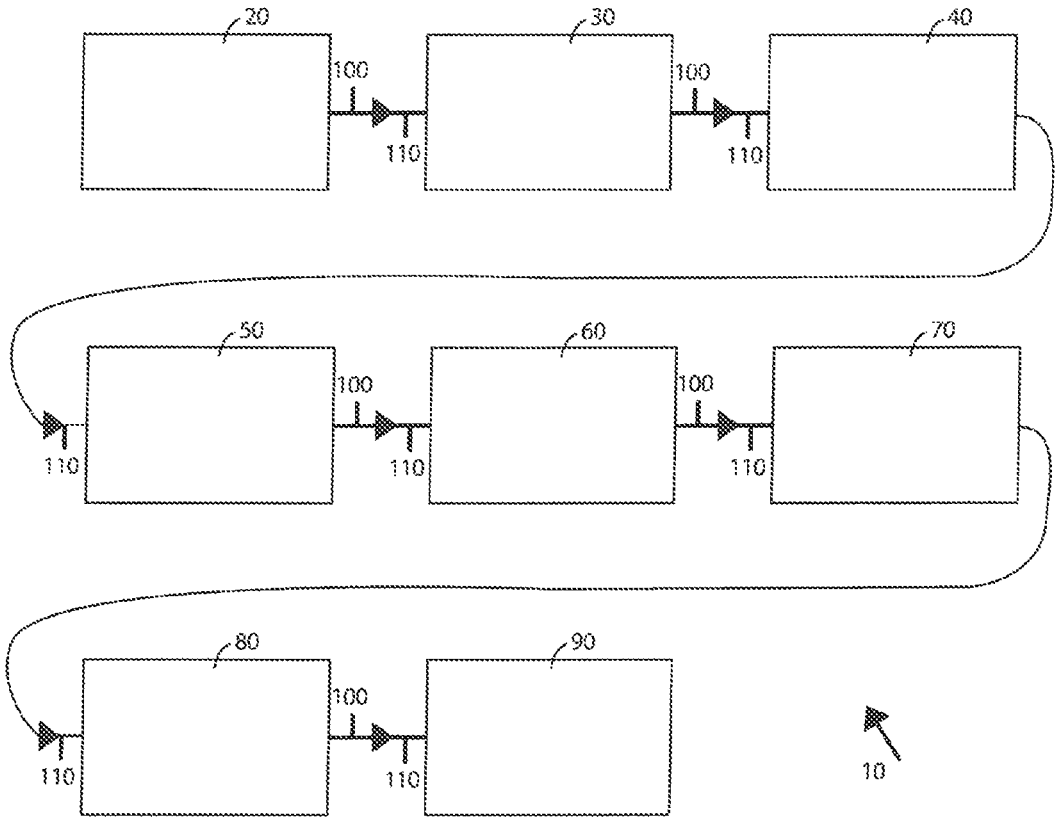
20
30
40
50
60
70
80
90
100
110
10

PROCESS FOR REUSING PRINTED CANS

CROSS-REFERENCE TO RELATED APPLICATION

This application claims the benefit of U.S. Provisional Application No. 62/719,981, filed Aug. 20, 2018, and titled: A METHOD FOR REUSING CANS BY OVER-COATING THEM.

TECHNICAL FIELD

This invention relates to a process for reusing cans with printing on their outer surface such that the cans do not need to be completely recycled. More particularly, the invention relates to a combination of steps of removing existing-print from printed cans, often made of metal, and covering them with a coating so a new print can then be applied to the cans to make them look like the first time the cans were made and printed.

BACKGROUND

There are many different types of cans that are printed directly on the cans, for example, food cans, beverage cans and aerosol cans. When these cans have print defects or outdated printing, the current practice is for these cans to be completely recycled by melting the can down and reusing the base material, often metal, into a new product. Other cans or containers can be reused by physically removing the label or cleaning the container and reusing it with the label that was already applied. However, this label removal option is not available when the existing printing on a can is directly to the can's outer surface or reuse of the same print does not make sense.

There are a variety of approaches, already in the art, to remove printing from surfaces but none meet the needs for cans, as provided by the present invention. Some existing methods use chemicals applied to the cans, which have obvious drawback. The disadvantage can be the type of chemicals, and in particular when the cans are for food or beverage use and getting the chemicals on an inside surface of the cans is not acceptable or would require additional rinsing steps to insure the chemicals are not present when it comes time to reuse the cans for food or beverage consumption. Alternately, the disadvantage can be the fact that the use of chemicals requires the constant replenishing of chemicals and handling the chemicals in a safe and effective way. Mechanically removing existing printing from cans is also challenging, because it can be too destructive to the cans and damage the side wall of the cans which is unacceptable especially when the cans are intended to be used for containing pressurized contents, like a carbonated beverage.

There are various coating means taught in the art, but these are also not acceptable. Some coating methods use too little coating and the existing printing is not sufficiently hidden for new printing and reusing of the cans. Other coating applications require too much coating material which adds to the costs of manufacture, as well as longer processing cycles.

Another problem with the existing methods in the art is encountered when trying to print on reused cans. That is, most reused cans have contaminants on their outer surface, e.g., necking oil applied to them in the can formation process. This oil is applied after the new can is printed as the cans are formed with a flat side wall, printed, and then necked in. This oil does not cause issues for use of the new cans, but it does prevent print from adhering to parts of the outer surface, in particular the upper part of the cans, when printed on later. This oil can be removed by cleaning each can with a solvent or cleaning solution, but that has obvious disadvantages as already noted.

Accordingly, a process is needed to be able to reuse cans where their only defect is the printing on the outer surface of the cans. And, in particular, when it is not possible to physically remove a label that contains the printing on the outer surface. And still further, when contaminants and oils (necking oil) create a surface that is not able to accept a print or coating. There is also a need for removing printing and then coating cans in an easy and consistent way, so reprinting on a used can will be very close to, and ideally the same as, when the can was new and printed the first time, giving a clean, professional looking printed can. There is also the need to do this in a rather high speed environment where steps can move sequentially from one to the next, and preferably in a continuous in-line process, which can also help reduce handling of the cans and increase overall quality and integrity of the reused cans.

SUMMARY

To address the need for an effective, consistent and/or efficient way to reuse printed cans, there is provided an in-line process for reusing printed cans. The process includes positioning a printed can in front of a laser, the printed can having existing-print on an outer surface of the printed can. Next is irradiating the outer surface of the printed can with laser radiation to remove 10% to 100% of the existing-print from the printed can and thereby form a lightened-printed can. And then, coating the outer surface of the lightened-printed can with a masking agent to form a blank-reprintable can.

In another embodiment there is an in-line continuous process for reusing printed cans. This process includes positioning a printed can in front of a laser, the printed can having existing-print on an outer surface of the printed can and the existing-print is cured on the printed can before the printed can begins this positioning step. Next is irradiating the outer surface of the printed can with laser radiation to remove 10% to 90% of the existing-print from the printed can and thereby form a lightened-printed can. A next step is coating the outer surface of the lightened-printed can with a masking agent to form a blank-reprintable can. And then, printing a new print-pattern on the outer surface of the blank-reprintable can to form a newly-printed can. And finally, forming at least 60 newly-printed cans in a minute.

In still another embodiment, there is an in-line continuous process for reusing printed cans. This includes positioning a printed can in front of a laser, the printed can having existing-print on an outer surface of the printed can, where the printed can has contaminants on the outer surface and the contaminants sit on top of the existing-print. And then, irradiating the outer surface of the printed can with laser radiation to remove 10% to 90% of the existing-print from the printed can and thereby form a lightened-printed can while also removing contaminants from the outer surface. Next is coating the outer surface of the lightened-printed can with a masking agent to form a blank-reprintable can. And next is using masking agent in an amount that is inversely proportional to the percentage of the existing-print removed from the printed can. And finally, forming at least 60 blank-reprintable cans in a minute.

In yet another embodiment, there is an in-line process for reusing pre-printed formed cans. The process includes positioning a pre-printed formed can in front of a laser, the pre-printed formed can having contaminants on an outer surface of the pre-printed formed can. Next is, irradiating the outer surface of the pre-printed formed can with laser radiation to remove substantially all of the contaminants from the pre-printed formed can and thereby form a clean-pre-printed can.

Also described herein are aspects directed to the type and nature of irradiating and irradiation used, how area specific or uniform that may be, and coupled to this, coating specifics related to amount of masking agent used and how area specific or uniform the masking agent may be applied.

Another aspect is directed to printing a new print-pattern on the outer surface of the blank-reprintable can to form a newly-printed can, thus completing the process to make a printed can reusable "like new."

Still other aspects concern the printed can having contaminants on the outer surface and using irradiation to assist in removal of them along with the existing-print, and doing this without materially degrading the interior lining of the printed cans.

Yet other aspects relate to speed of the process and forming at least 60 blank-reprintable cans in a minute, and for example, at least the steps of positioning, irradiating and coating occur in-line with cans moving continuously from one step to the next.

BRIEF DESCRIPTION OF THE DRAWINGS

The invention may be more completely understood in consideration of the following detailed description of various embodiments of the invention in connection with the accompanying drawing, in which:

The FIGURE is a diagrammatic view of an embodiment of the process depicting process steps and their relationships.

The drawing shows some but not all embodiments. The elements depicted in the drawing are illustrative and not necessarily to scale, and the same (or similar) reference numbers denote the same (or similar) features throughout the drawing.

DETAILED DESCRIPTION

In accordance with the practice of at least one embodiment of the invention, as seen in the FIGURE, there is a process 10 for reusing printed cans. The process can include a variety of steps, and practically speaking, these steps are sequential, but they need not be continuous. That is, the steps could be done in batches of cans, and not necessarily have cans move through each step continuously one step immediately after the other. In the FIGURE, number 100 representing the line from a box and including the arrow depicts the in-line nature of the inventive process and how one step flows to the next. Optionally, and preferably, the process is continuous, as seen by number 110 representing the line extending between the tip of the arrow and the next process box. The process includes positioning a printed can in front of a laser. For example, this could involve step 20 of depalletizing printed cans having existing-print on an outer surface of the printed can and step 30 to place the cans on a conveyor which brings them to the laser.

Next, the printed cans with existing-print go to step 40 for irradiating the outer surface of the printed can with laser radiation to remove 10% to 100% of the existing-print from the printed can and thereby form a lightened-printed can. This removal could be removing all or some of the existing-print over 10% to 100% of the outer surface, and preferably is removing 10% to 100% of the existing-print from the printed can substantially uniformly across the entire outer surface to form the lightened-printed can all around its outer surface. Even more preferably, and in increasing degrees of preference, the removal can be from 20% to 90%, from 30% to 80%, from 40% to 70% from 40% to 60%, and from 45% to 55%. —The lightening of the print on the printed can is calculated visually, for example, by measuring the color density of the print using a spectrophotometer and comparing the color density prior to irradiating and after the step of irradiating is complete.

Without being limited to a particular laser or irradiation source, the laser made by IPG Photonics™ Corporation with offices in Oxford, Mass. 01540, and known as a YLPN 1-100 mJ, 500-1000 W high power nanosecond ytterbium fiber laser (and these specifics, for example, YLPN-1kW-R model with 400 um fiber, 400/140=1.14 mm spot; as a 3 phase 480 volt power, two 30 amp, one 50 amp drops), is effective to remove existing-print from printed cans. Preferably, this laser is also coupled to a IPG High Power Scanner—2D of IPG Photonics Corporation, to move the laser over the desired area(s) of the outer surface of the existing-print cans. While various lasers and radiation sources may be employed, care should be taken to not damage an interior lining of the printed cans by, for example, too strongly irradiating the outer surface across the entire outer surface or at a point or points on its outer surface. That is, preferably, irradiating includes utilizing the laser radiation with an irradiation intensity that does not materially degrade the interior lining. This can be particularly important when food or beverage will be the contents going into the newly-printed cans, or contents are under pressure and a weakened point or place could cause can rupture, can explosion or contamination of the contents somehow.

A few discoveries were needed and made by the inventors and such led, at least in part, to the combination of using laser irradiation and the next step coating. One discovery was the situation often encountered where the existing-print was cured on the printed can before the printed can begins the positioning step. As such, the existing-print is difficult to remove and makes prior tools and techniques inadequate when desiring to reuse the printed cans and also not damage the same (outer surface or interior lining) in the removal or coating process. Further, the printed cans are often made of metal, such as aluminum or steel or alloys including these, and then filled with food, beverage, paint, chemicals or other contents. Still further, the printed cans were first made and intended to be filled with contents, but due to whatever reason (e.g., too many printed cans made, an order changed, printing was in error in some way) the cans formed as printed cans were not used and filled with contents. As such, the printed can of the inventive process is empty of content in each of the steps of the process, also adding to the care that must be taken in handling and positioning of the cans throughout the process to best insure their quality and integrity for reuse once the inventive process is complete.

Another discovery made was getting the coating to stick to the outer surface of printed cans, that is the inventors discovered that some sort of treatment was required (e.g., flame treatment, plasma treatment, or other surface altering treatment) to adjust surface tension of the printed cans so the can would accept and retain the coating during intended use of the newly-printed can. Also, the inventors were addressing a concern that digital printing technologies generally did not allow cans to be printed on the top necked in area of the can. As part of the invention development, laser irradiation was surprisingly discovered as a way to aid in both existing-print removal and better coating application and retention. Without being limited to a theory of understanding, these discoveries enabled the inventors to, more efficiently and effectively than ever before, make newly-printed cans.

In another embodiment of the invention that specifically takes advantage of the learning relating to irradiating cans, is an in-line process for reusing pre-printed formed cans. These are cans that are formed without any printing, also known as "brite" cans, and have contaminants such as oil on the outer surface of the pre-printed formed can (i.e., for similar reasons as the printed formed cans). These cans, similar to the printed cans, were abandoned midstream in the can forming and filling process and now will be reused as cans to be eventually printed, and filled with liquid for their original intended use. A first step is positioning the pre-printed formed can in front of the laser, the pre-printed formed can having contaminants on the outer surface of the pre-printed formed can. Then the can is subject to irradiating the outer surface of the pre-printed formed can with laser radiation to remove substantially all of the contaminants from the pre-printed formed can and thereby form a clean-pre-printed can. At this point, the clean-pre-printed can is essentially the same as the lightened-printed can, and the subsequent steps of the process are the same for each type of can. For example, next is coating the outer surface of the clean-pre-printed can (i.e., as described more below, for the analogous lightened-printed cans) with a masking agent to form a blank-reprintable can. Alternately, for example, the process could proceed right to printing a new print-pattern on the outer surface of the clean-pre-printed can to form a newly-printed can (i.e., go from irradiating right to printing and skip coating).

Next is step 50, coating the outer surface of the lightened-printed can with a masking agent to form a blank-reprintable can. For example, this can be by painting or powder coating, and applied by spraying, rolling, or dipping, and with water based or solvent based agents. This may also be, preferably but optionally, by electrostatically applying the masking agent which also helps in securing the agent to the lightened-printed can. One or more coats may be applied, as discussed hereafter concerning amount of coating used, but not so many coats that dripping or running of the coating occurs. Further, if desired, the process may include step 60 of curing the coating.

Curing can be by any conventional process known for the coating used, e.g., heating, drying, imparting a particular wavelength of light like UV, exposure of another chemical. In one embodiment, when coating is complete, the masking agent can be applied on as a coating of about 0.4 to 1 mil thick, and in order of increasing preference for thickness (but also dependent on the amount of irradiation used to form the lightened-printed cans) from 0.5 to 0.9 mils, from 0.6 to 0.8 mils, and about 0.7 mils. Additionally, if desired, a bottom of the existing-print cans can be coated, as well as the outer surface sides with the existing-print, and thereafter the bottom can be printed to provide for a more premium looking newly-printed can plus other fringe benefits that a coating provides to a metal can by sealing the metal.

Coating may, preferably, use masking agent in an amount that is inversely proportional to the percentage of the existing-print removed from the printed can. In this way better advantage is made of combining the irradiating and coating steps to more effectively and efficiently make blank-reprintable cans, and this may also help the cans take on and hold the new print when that occurs. To be clear, by inversely proportional it means the more removal of existing print that occurs then the less the amount of masking agent needed (i.e., and vice versa—less removal of existing print then the greater the amount of masking agent needed) to form a blank-reprintable can with acceptable characteristics for printing a new print-pattern on the outer surface that will have a like-new appearance. Challenges to achieving a like-new appearance would be if the original print on the printed can showed through the blank-reprintable can surface somewhere along side or under the newly-printed can surface or the new-print pattern is in some way degraded in appearance by the existing-print. Still more preferably, and at least in part to address some of these challenges, the coating step may include applying the masking agent substantially uniformly across the outer surface to form the blank-reprintable can. While a variety of pigments may be employed as the masking agent, particular success has been found with white paint, for example. Without being limited to a particular coating machine or applicator, the coater made by Carlisle® Fluid Technologies UK Ltd of Bournemouth Dorset, UK BH119LH, and known as a Ransburg Aerobell 168 to provide high quality atomization in a compact robust unit, is effective for coating lightened-printed cans.

With blank-reprintable cans complete, next is printing step 80 where a new print-pattern is printed on the outer surface of each blank-reprintable can to form newly-printed cans. This can also include step 70 of removing cans from the conveyor where they were coated and cured and putting them onto a new conveyor to bring them to print step 80. Various conventional printing technologies can be used, and will be acceptable to make like-new newly-printed cans from the printed cans that have gone through the inventive process. And preferably, printing step 80 includes digital print applied to the outer surface of the blank-reprintable can. Digital print tends to be more versatile and effective, than other print techniques, to form newly-printed cans of the invention. After this, the newly-printed cans can be repalletized at step 90, if finish forming and filling will not happen in-line.

In another aspect of the invention, the printed can has contaminants on the outer surface and the contaminants sit on top of the existing-print. Such a contaminant may be oil, necking oil or other chemicals used to make printed cans after the original print is applied to the printed can's outer surface, and in particular applied to help form the printed cans into closed cans with contents inside before the printed cans were no longer needed and then redirected to enter the inventive process on their path to being reused. When employing printed cans in the invention, if the contaminants are not removed before printing the new print-pattern, printing can be difficult to impossible. Thus, preferably, irradiating includes removing contaminants from the outer surface, and more preferably, removing includes removing substantially all of the oil (and even more preferably all contaminants) from the outer surface.

Other aspects of the invention are directed to the commercial nature of the process and preferably its high speed capabilities to make many lightened-printed cans, blank-reprintable cans, or newly-printed cans, more preferably at least two of these types of cans, and most preferably all three of these types of cans, in a minute. For example, this may be completing at least 60 such cans in a minute, preferably 90 such cans in a minute, more preferably 120 such cans in a minute, and most preferably greater than 120 such cans in a minute. In this regard, and at least in part to help achieve these speeds (i.e., but can also be to help reduce handling and thus enhance integrity and quality of the cans), at least the steps of positioning, irradiating and coating occur in-line with cans moving continuously from one step to the next and not in a batch process.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the packaging arts, and all such modifications and other embodiments are intended and deemed to be within the scope of the present invention.

What is claimed is:

1. An in-line process for reusing printed cans comprising:

positioning a printed can in front of a laser, the printed can having existing-print on an outer surface of the printed can;

irradiating the outer surface of the printed can with laser radiation to remove 10% to 100% of the existing-print from the printed can and thereby form a lightened-printed can;

wherein positioning comprises moving the laser over a desired area of the outer surface of the printed can to remove the 10% to 100% of the existing-print from the printed can and without materially degrading an interior lining of the lightened-printed can;

coating the outer surface of the lightened-printed can with a masking agent to form a blank-reprintable can, wherein irradiating aids in the masking agent coating the outer surface and being retained thereon; and, curing the masking agent of the blank-reprintable can.

2. The in-line process of claim 1, wherein the irradiating step comprises removing the 10% to 100% of the existing-print from the printed can substantially uniformly across the outer surface to form the lightened-printed can.

3. The in-line process of claim 1, further comprising printing a new print-pattern on the outer surface of the blank-reprintable can to form a newly-printed can.

4. The in-line process of claim 3, wherein printing comprises digital print applied to the outer surface of the blank-reprintable can.

5. The in-line process of claim 1, wherein the printed can has contaminants on the outer surface and the contaminants sit on top of the existing-print.

6. The in-line process of claim 5, wherein irradiating comprises removing contaminants from the outer surface.

7. The in-line process of claim 6, wherein the contaminants comprise oil and removing comprises removing substantially all of the oil from the outer surface.

8. The in-line process of claim 1, wherein the printed can comprises an interior lining and irradiating comprises utilizing the laser radiation with an irradiation intensity that does not materially degrade the interior lining.

9. The in-line process of claim 1, wherein coating comprises using masking agent in an amount that is inversely proportional to the percentage of the existing-print removed from the printed can.

10. The in-line process of claim 1, wherein coating comprises electrostatically applying the masking agent.

11. The in-line process of claim 1, wherein coating comprises applying the masking agent substantially uniformly across the outer surface to form the blank-reprintable can.

12. The in-line process of claim 1, wherein the masking agent comprises a white paint.

13. The in-line process of claim 1, wherein the existing-print is cured on the printed can before the printed can begins the positioning step.

14. The in-one process of claim 1, wherein the printed can is empty of content in each of the steps of the process.

15. The in-line process of claim 1, further comprising forming at least 60 blank-reprintable cans in a minute.

16. The in-line process of claim 1, wherein at least the steps of positioning, irradiating and coating occur in-line with cans moving continuously from one step to the next.

17. An in-line continuous process for reusing printed cans comprising:

positioning a printed can in front of a laser, the printed can having existing-print on an outer surface of the printed can and the existing-print is cured on the printed can before the printed can begins this positioning step;

irradiating the outer surface of the printed can with laser radiation to remove 10% to 90% of the existing-print from the printed can and thereby form a lightened-printed can;

wherein positioning comprises moving the laser over a desired area of the outer surface of the printed can to remove the 10% to 90% of the existing-print from the printed can and without materially degrading an interior lining of the lightened-printed can;

coating the outer surface of the lightened-printed can with a masking agent to form a blank-reprintable can, wherein irradiating aids in the masking agent coating the outer surface and being retained thereon;

printing a new print-pattern on the outer surface of the blank-reprintable can to form a newly-printed can; and, forming at least 60 newly-printed cans in a minute.

18. The in-line continuous process of claim 17, wherein the irradiating step comprises removing the 10% to 90% of the existing-print from the printed can substantially uniformly across the outer surface to form the lightened-printed can.

19. The in-line continuous process of claim 17, further comprising curing the masking agent of the blank-reprintable can.

20. The in-line continuous process of claim 19, wherein the curing step concludes before the printing step begins.

21. An in-line continuous process for reusing printed cans comprising:

positioning a printed can in front of a laser, the printed can having existing-print on an outer surface of the printed can, where the printed can has contaminants on the outer surface and the contaminants sit on top of the existing-print;

irradiating the outer surface of the printed can with laser radiation to remove 10% to 90% of the existing-print from the printed can and thereby form a lightened-printed can while also removing contaminants from the outer surface;

wherein positioning comprises moving the laser over a desired area of the outer surface of the printed can to remove the 10% to 90% of the existing-print from the printed can and without materially degrading an interior lining of the lightened-printed can;

coating the outer surface of the lightened-printed can with a masking agent to form a blank-reprintable can, wherein irradiating aids in the masking agent coating the outer surface and being retained thereon;

using masking agent in an amount that is inversely proportional to the percentage of the existing-print removed from the printed can; and, forming at least 60 blank-reprintable cans in a minute.

22. The in-line continuous process of claim 21, wherein coating comprises applying the masking agent substantially uniformly across the outer surface to form the blank-reprintable can.

23. The in-line continuous process of claim 21, wherein the contaminants comprise oil and irradiating comprises removing substantially all of the oil from the outer surface.

24. The in-line continuous process of claim 21, further comprising curing the masking agent of the blank-reprintable can.

* * * * *